United States Patent [19]

Smith et al.

[11] 4,282,298

[45] Aug. 4, 1981

[54] LAYERED IMAGING MEMBER AND METHOD

[75] Inventors: Michael Smith, Rochester; Charles F. Hackett, Williamson; Richard W. Radler, Marion, all of N.Y.

[73] Assignee: Xerox Corporation, Stamford, Conn.

[21] Appl. No.: 371,647

[22] Filed: Jun. 20, 1973

Related U.S. Application Data

[63] Continuation-in-part of Ser. No. 94,139, Dec. 1, 1970, which is a continuation-in-part of Ser. No. 14,280, Feb. 26, 1970, abandoned.

[51] Int. Cl.[3] ..... G03G 5/08; G03G 5/14

[52] U.S. Cl. ..... 430/58

[58] Field of Search ..... 96/1 R, 1.5, 1.6; 252/501; 430/58, 96

[56] References Cited

U.S. PATENT DOCUMENTS

| | | | |
|---|---|---|---|
| 2,901,348 | 8/1959 | Dessauer et al. | 96/1.5 |
| 3,287,120 | 11/1966 | Hoegl | 96/1.5 |
| 3,598,582 | 8/1971 | Herrick et al. | 96/1.5 |
| 3,725,058 | 4/1973 | Hayashi et al. | 96/1.5 |

FOREIGN PATENT DOCUMENTS

| | | | |
|---|---|---|---|
| 720358 | 9/1968 | Belgium | 96/1.5 |
| 43-16198 | 7/1968 | Japan | 96/1.5 |
| 941069 | 11/1963 | United Kingdom | 96/1.5 |

*Primary Examiner*—Roland E. Martin, Jr.
*Attorney, Agent, or Firm*—E. O. Palazzo; J. P. O'Sullivan; G. D. Maccrone

[57] ABSTRACT

A photosensitive member having at least two electrically operative layers. The first layer comprises a photoconductive layer which is capable of photogenerating and injecting photo-excited holes into a contiguous active layer. The active layer comprises a transparent organic material which is substantially non-absorbing in the spectral region of intended use, but which is "active" in that it allows injection of photo-excited holes from the photoconductive layer, and allows these holes to be transported through the active layer. This structure may be imaged in the conventional xerographic mode which usually includes charging, exposure to light, and development.

25 Claims, 11 Drawing Figures

LAYERED IMAGING MEMBER AND METHOD

BACKGROUND OF THE INVENTION

This application is a continuation-in-part of copending application, Ser. No. 94,139, filed Dec. 1, 1970, which is a continuation-in-part of application, Ser. No. 14,280 filed Feb. 26, 1970, and now abandoned.

This invention relates in general to xerography and more specifically to a novel photosensitive device and method of use.

In the art of xerography, a xerographic plate containing a photoconductive insulating layer is imaged by first uniformly electrostatically charging its surface. The plate is then exposed to a pattern of activating electromagnetic radiation such as light, which selectively dissipates the charge in the illuminated areas of the photoconductive insulator while leaving behind a latent electrostatic image in the non-illuminated areas. This latent electrostatic image may then be developed to form a visible image by depositing finely divided electroscopic marking particles on the surface of the photoconductive insulating layer.

A photoconductive layer for use in xerography may be a homogeneous layer of a single material such as vitreous selenium or it may be a composite layer containing a photoconductor and another material. One type of composite photoconductive layer used in xerography is illustrated by U.S. Pat. No. 3,121,006 to Middleton and Reynolds which describes a number of binder layers comprising finely-divided particles of photoconductive inorganic compound dispersed in an electrically insulating organic resin binder. In its present commercial form, the binder layer contains particles of zinc oxide uniformly dispersed in a resin binder and is coated on a paper backing.

In the particular examples of binder systems described in Middleton et al, the binder comprises a material which is incapable of transporting injected charge carriers generated by the photoconductor particles for any significant distance. As a result, with the particular materials disclosed in the Middleton et al patent, the photoconductor particles must be in substantially continuous particle-to-particle contact throughout the layer in order to permit the charge dissipation required for stable cyclic operation. With the uniform dispersion of photoconductor particles described in Middleton et al, therefore, a relatively high volume concentration of photoconductor, up to about 50 percent or more by volume, is usually necessary in order to obtain sufficient photoconductor particle-to-particle contact for rapid discharge. It has been found, however, that high photoconductor loadings in the binder layers of the resin type result in the physical continuity of the resin being destroyed, thereby significantly reducing the mechanical properties of the binder layer. Layers with high photoconductor loadings are often characterized by a brittle binder layer having little or no flexibility. On the other hand, when the photoconductor concentration is reduced appreciably below about 50 percent by volume, the discharge rate is reduced, making high speed cyclic or repeated imaging difficult or impossible.

U.S. Pat. No. 3,121,007 to Middleton et al teaches another type of photoconductor which includes a two phase photoconductive binder layer comprising photoconductive insulating particles dispersed in a homogeneous photoconductive insulating matrix. The photoconductor is in the form of a particulate photoconductive inorganic crystalline pigment broadly disclosed as being present in an amount from about 5 to 80 percent by weight. Photodischarge is said to be caused by the combination of charge carriers generated in the photoconductive insulating matrix material and charge carriers injected from the photoconductive crystalline pigment into the photoconductive insulating matrix.

U.S. Pat. No. 3,037,861 to Hoegl et al teaches that polyvinyl carbazole exhibits some long-wave U. V. sensitivity and suggests that its spectral sensitivity be extended into the visible spectrum by the addition of dye sensitizers. Hoegl et al further suggests that other additives such as zinc oxide or titanium dioxide may also be used in conjunction with polyvinyl carbazole is intended to be used as a photoconductor, with or without additive materials which extend its spectral sensitivity.

In addition to the above, certain specialized layered structures particularly designed for reflex imaging have been proposed. For example, U.S. Pat. No. 3,165,405 to Hoesterey utilizes a two layered zinc oxide binder structure for reflex imaging. The Hoesterey patent utilizes two separate contiguous photoconductive layers having different spectral sensitivities in order to carry out a particular reflex imaging sequence. The Hoesterey device utilizes the properties of multiple photoconductive layers in order to obtain the combined advantages of the separate photoresponse of the respective photoconductive layers.

It can be seen from a review of the conventional composite photoconductive layers cited above, that upon exposure to light, photoconductivity in the layered structure is accomplished by charge transport through the bulk of the photoconductive layer, as in the case of vitreous selenium (and other homogeneous layered modifications). In devices employing photoconductive binder structures, which include inactive electrically insulating resins such as those described in the Middleton et al, U.S. Pat. No. 3,121,006, conductive or charge transport is accomplished through high loadings of the photoconductive pigment allowing particle-to-particle contact of the photoconductive particles. In the case of photoconductive particles dispersed in a photoconductive matrix, such as illustrated by the Middleton et al, U.S. Pat. No. 3,121,007, photoconductivity occurs through the generation of charge carriers in both the photoconductive matrix and the photoconductor pigment particles.

Although the above patents rely upon distinct mechanisms of discharge throughout the photoconductive layer, they generally suffer from common deficiencies in that the photoconductive surface during operation is exposed to the surrounding environment, and particularly in the case of cycling xerography, susceptible to abrasion, chemical attack, heat, and multiple exposures to light during cycling. These effects are characterized by a gradual deterioration in the electrical characteristics of the photoconductive layer resulting in the printing out of surface defects and scratches, localized areas of persistent conductivity which fail to retain an electrostatic charge, and high dark discharge.

In addition to the problems noted above, these photoconductive layers require that the photoconductor comprise either a hundred percent of the layer, as in the case of the vitreous selenium layer, or that they preferably contain a high proportion of photoconductive material in the binder configuration. The requirements of a photoconductivwe layer containing all or a major proportion of a photoconductive material further restricts the physical characteristics of the final plate, drum or belt in that the physical characteristics such as flexibility and adhesion of the photoconductor to a supporting substrate are primarily dictated by the physical properties of the photoconductor, and not by the resin or matrix material which is preferably present in a minor amount.

Another form of composite photosensitive layer which has also been considered by the prior art includes a layer of photoconductive material which is covered with a relatively thick plastic layer and coated on a supporting substrate.

U.S. Pat. No. 3,041,166 to Bardeen describes such a configuration in which a transparent plastic material overlays a layer of vitreous selenium which is contained on a supporting substrate. The plastic material is described as one having a long range for charge carriers of the desired polarity. In operation, the free surface of the transparent plastic is electrostatically charged to a given polarity. The device is then exposed to activating radiation which generates a hole-electron pair in the photoconductive layer. The electron moves through the plastic layer and neutralizes a positive charge on the free surface of the plastic layer thereby creating an electrostatic image. Bardeen, however, does not teach any specific plastic materials which will function in this manner, and confines his examples to structures which use a photoconductor material for the top layer.

French Pat. No. 1,577,855 to Herrick et al describes a special purpose composite photosensitive device adapted for reflex exposure by polarized light. One embodiment which employs a layer of dichroic organic photoconductive particles arrayed in oriented fashion on a supporting substrate and a layer of polyvinyl carbazole formed over the oriented layer of dichroic material. When charged and exposed to light polarized perpendicularly to the orientation of the dichroic layer, the oriented dichroic layer and polyvinyl carbazole layer are both substantially transparent to the initial exposure light. When the polarized light hits the white background of the document being copied, the light is depolarized, reflected back through the device and absorbed by the dichroic photoconductive material. In another embodiment, the dichroic photoconductor is dispersed in oriented fashion throughout the layer of polyvinyl carbazole.

In view of the state of the art, it can readily be seen that there is a need for a general purpose photoreceptor exhibiting acceptable photoconductive characteristics and which additionally provides the capability of exhibiting outstanding physical strength and flexibility to be reused under rapid cyclic conditions without the progressive deterioration of the xerographic properties due to wear, chemical attack, and light fatigue.

OBJECTS OF THE INVENTION

It is, therefore, an object of this invention to provide a novel photosensitive device adapted for cyclic imaging which overcomes the above noted disadvantages.

It is a further object of this invention to provide a novel imaging system.

It is a further object of this invention to provide a photosensitive member which exhibits efficient hole photogeneration and transport.

It is another object of this invention to provide a novel photosensitive layered device.

It is a further object of this invention to provide a novel method of imaging a photosensitive layered device.

It is yet another object of this invention to provide a novel photosensitive device which is capable of exhibiting outstanding mechanical properties.

SUMMARY OF THE INVENTION

The foregoing objects and others are accomplished in accordance with this invention by providing a photosensitivwe member having at least two operative layers. The first layer comprises a layer of unoriented photoconductive material which is capable of photogenerating and injecting photo-excited holes into a contiguous or adjacent active overcoating. The active material comprises a transparent organic polymer or nonpolymeric insulating material which is substantially nonabsorbing to visible light or radiation in the region of intended use, but which is active in that it allows the injection of photo-excited holes from the photoconductive layer and allows these holes to be transported through the active layer to selectively discharge a surface charge on the free surface of the active layer.

It should be understood that the active layer does not function as a photoconductor in the wavelength region of use. As stated above, hole-electron pairs are photogenerated in the photoconductive layer and the holes are then injected into the active layer and hole transport occurs through the active layer.

A typical application of the instant invention includes the use of a sandwich cell or layered configuration which in one embodiment consists of a supporting substrate such as a conductor containing a photoconductive layer thereon. For example, the photoconductive layer may be in the form of a layer of amorphous or vitreous selenium. A transparent polymeric layer, which alloys for hole injection and transport, is coated over the selenium photoconductive layer. Generally, a thin interfacial barrier or blocking layer is sandwiched between the photoconductive layer and the active layer. This barrier layer may comprise any suitable electrically insulating material such as metallic oxide or organic resin. The use of the transparent active polymer layer allows one to take advantage of placing a photoconductive layer adjacent to a supporting substrate, and protecting the photoconductive layer with a top surface which will allow for the transport of photo-excited holes from the photoconductor, and at the same time function to physically protect the photoconductive layer from environmental conditions. This structure can then be imaged in the conventional xerographic manner which usually includes charging, optical projection exposure, and development.

In general, the advantages of the improved structure and method of imaging will become apparent upon consideration of the following disclosure of the invention; especially when taken in conjunction with the accompanying drawings wherein:

DETAILED DESCRIPTION OF THE DRAWINGS

Figure 2:
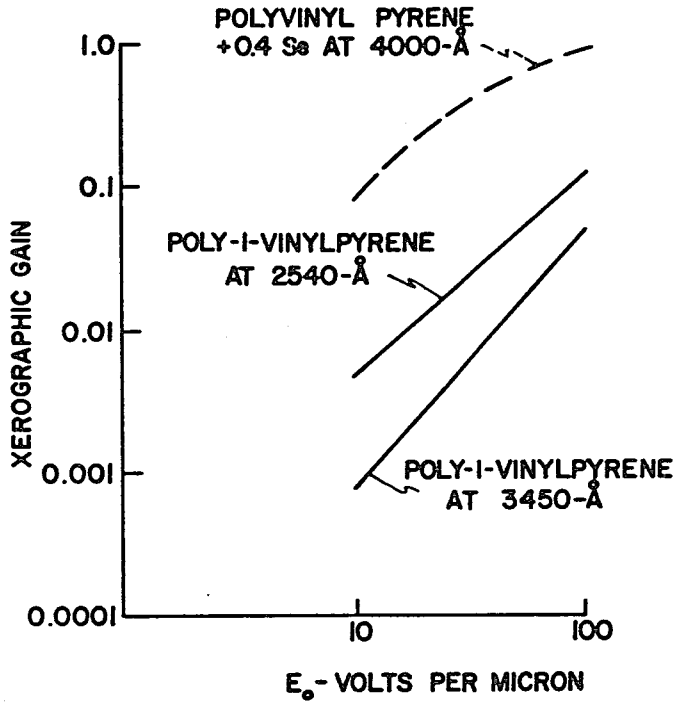
FIG. 2 is a plot similar to FIG. 1 for a second active material.

As defined herein, a photoconductor is a material which is electrically photoresponsive to light in the wavelength region in which it is to be used. More specifically, it is a material whose electrical conductivity increases significantly in response to the absorption of electromagnetic radiation in a wavelength region in which it is to be used. This definition in necessitated by the fact that a vast number of aromatic organic compounds are known or expected to be photoconductive when irradiated with strongly absorbed ultraviolet, x-ray, or gamma-radiation. Photoconductivity in organic materials is a common phenomenon. Practically all highly conjugated organic compounds exhibit some degree of photoconductivity under appropriate conditions. Many of these organic materials have their prime wavelength response in the ultraviolet. However, little commercial utility has been found for ultraviolet responsive materials, and their short wavelength response is not particularly suitable for document copying or color reproduction. In view of the general prevelance of photoconductivity in organic compounds following short wavelength excitation, it is therefore necessary that for the instant invention, the term "photoconductor" or "photoconductive" be understood to include only those materials which are in fact photoresponsive in the wavelength region in which they are to be used.

The active material, which is also referred to as the active matrix material when used as a matrix for a binder layer, is a substantially non-photoconductive material which supports an injection efficiency of photo-excited holes from the photoconductive layer of at least about 10 percent at fields of about $2\times10^5$ volts/cm. This material is further characterized by the ability to transport the carrier at least $10^{-3}$ cm. at a field of no more than about $10^6$ volts/cm. In addition, the active material is substantially transparent in the wavelength region in which the device is to be used.

The active transport material which is employed in conjunction with the photoconductive layer in the instant invention is a material which is an insulator to the extent that an electrostatic charge placed on said active binder material is not conducted in the absence of illumination, at a rate sufficient to prevent the formation and retention of an electrostatic latent image thereon. In general, this means that the specific resistivity of the active transport material should be at least about $10^{10}$ ohm-cms.

As can be seen from the above discussion, most materials which are useful for active layers of the instant invention are incidentially also photoconductive when radiation of wavelengths suitable for electronic excitation is absorbed by them. However, photoresponse in the short wavelength region, which falls outside the spectral region for which the photoconductor is to be used, is irrelevant to the performance of the device. It is well known that radiation must be absorbed in order to excite photoconductive response, and the transparency criteria stated above for the active materials implies that these materials do not contribute significantly to the photoresponse of the photoreceptor in the wavelength region of use.

Figure 1:
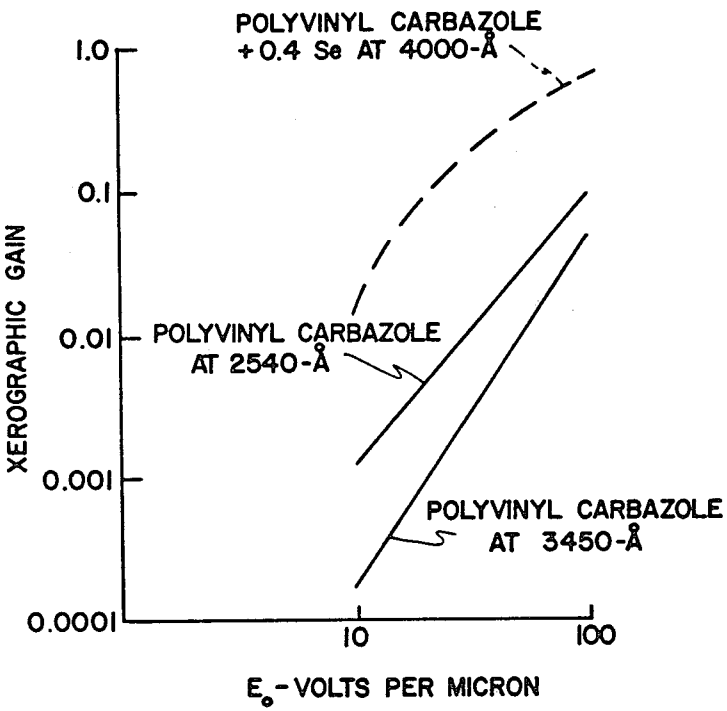
FIG. 1 illustrates a plot of photosensitivity versus field dependence for an active material alone, and in conjunction with a photoconductor.

The reason for the requirement that the active materials must be transparent is based upon the discovery that under all practical conditions, the efficiency of photoinjection from the photoconductor into the active materials, for visible radiation absorbed by the photoconductor, far exceeds the intrinsic photosensitivity of the active material in any wavelength region—visible or otherwise. This situation is illustrated by FIGS. 1 and 2 which shows a comparison of the field dependence of the injection sensitivity of the photoconductor selenium into typical active materials and the intrinsic photosensitivity of two active materials—polyvinyl carbazole and polyvinyl pyrene, each measured at wavelengths of high response. The polyvinyl carbazole and polyvinyl pyrene curves of FIGS. 1 and 2, respectively, are measured on samples 20 microns thick contained on an aluminum substrate and prepared by the method of Example I. The curves for the layered structures of the same materials having a 0.4 micron layer of vitreous selenium formed between the layer of active material and substrate are similar to the structure illustrated by FIG. 9 and are made by the method set forth in Example III. The data of FIGS. 1 and 2 is determined by plotting the initial xerographic gain (G) as a function of the applied field. The xerographic gain was calculated from the initial discharge rate $$G = \frac{(dV/dt)_{t=o}}{(eId/\epsilon)}$$

where I is the incident photon flux, d the thickness of the layer, the electric permittivity, and e the electronic charge. A xerographic gain of unity would be observed if one charge carrier per incident photon were excited and moved across the layer. It is clear from FIGS. 1 and 2 that the intrinsic photoconductivity of the active materials at their peak wavelengths of absorption (U. V. excitation) leads to gains considerably lower than the two phase structure incorporating efficient photoconductive materials, such as illustrated by the layered structures employing the thin selenium layers with suitable active materials, which can achieve gains of approximately 0.70 at a field of about $10^6$ volts/cm, using an excitation wavelength within the visible spectrum (4000 Å–8000 Å). It is also clear from FIGS. 3 and 4 that the typical active materials mentioned above will exhibit negligible, if any, discharge when exposed to a wavelength of light useful in xerography, i.e., 4000 Å–8000 Å. The obvious improvement in performance which results from the use of the two phase systems can best be realized if the active material is substantially transparent to radiation in a region in which the photoconductor is to be used; for any absorption of desired radiation by the active material will prevent this radiation from reaching the photoconductive layer where it is much more effectively utilized. It therefore follows that it is advantageous to use active materials which are transparent in the wavelength in which the photoconductor has its main response, and more particularly in the wavelength region in which the photoconductor is to be used.

It is not the intent of this invention to restrict the choice of active materials to those which are transparent in the entire visible region. For example, when used with a transparent substrate, imagewise exposure may be accomplished through the substrate without the light passing through the layer of active material. In this case the active material need not be non-absorbing in the wavelength region of use. Other applications where complete transparency is not required for the active material in the visible region include the selective recording of narrow-band radiation such as that emitted from lasers, spectral pattern recognition, and possible functional color xerography such as color coded form duplication.

Figure 3:
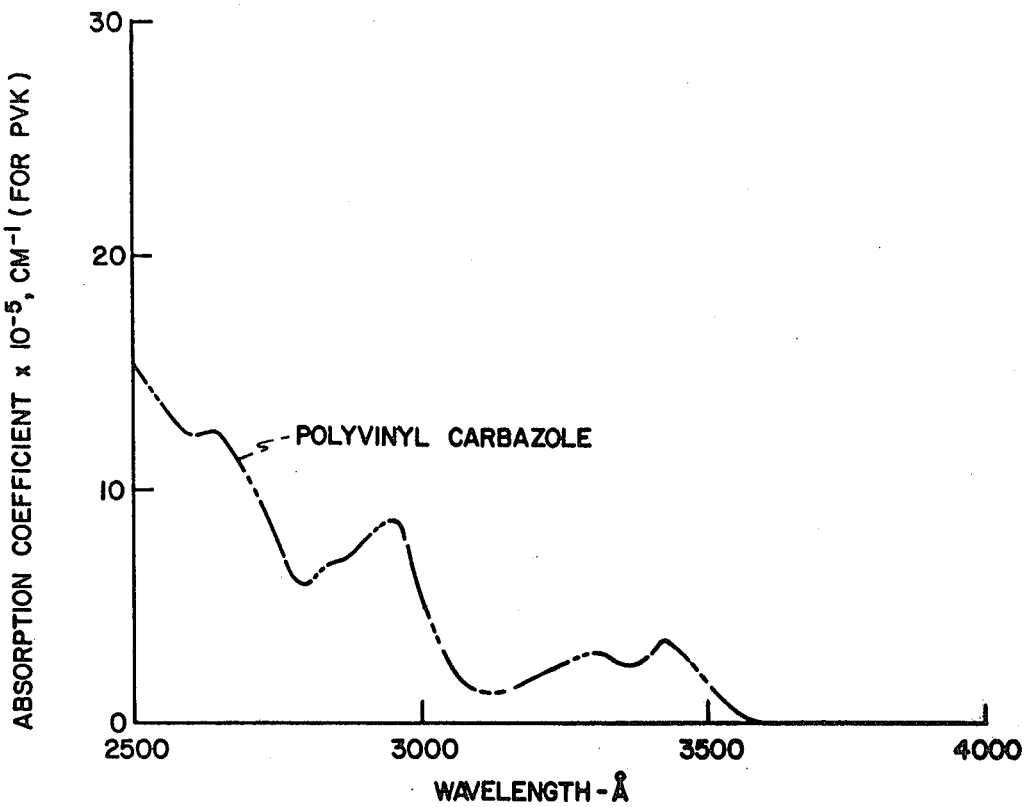
FIG. 3 represents a plot of the absorption spectrum for polyvinyl carbazole.
Figure 4:
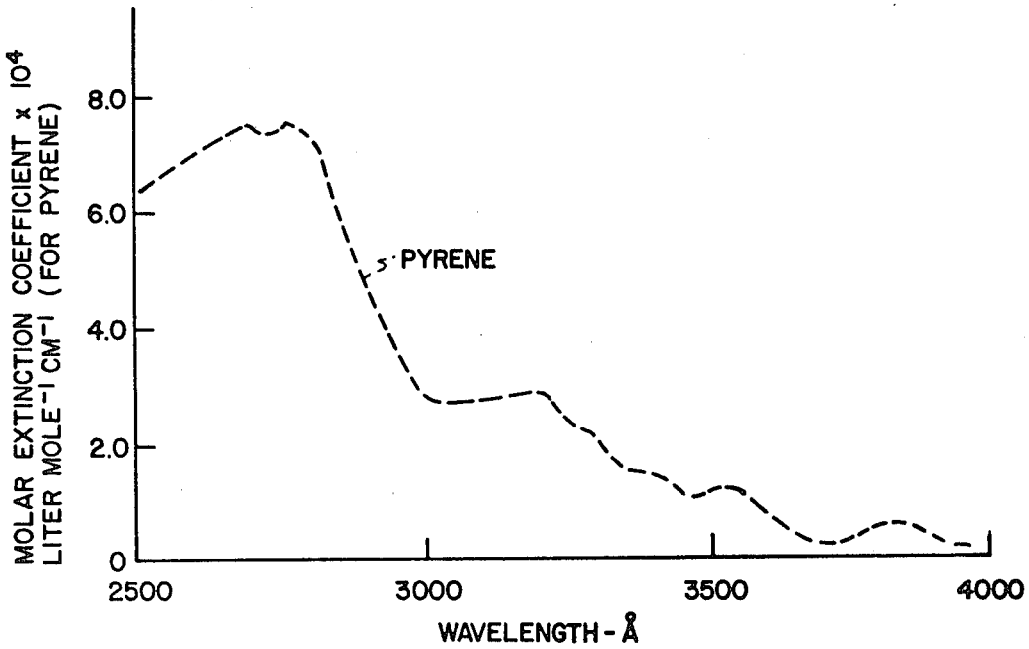
FIG. 4 represents a plot of the absorption spectrum for pyrene.
Figure 5:
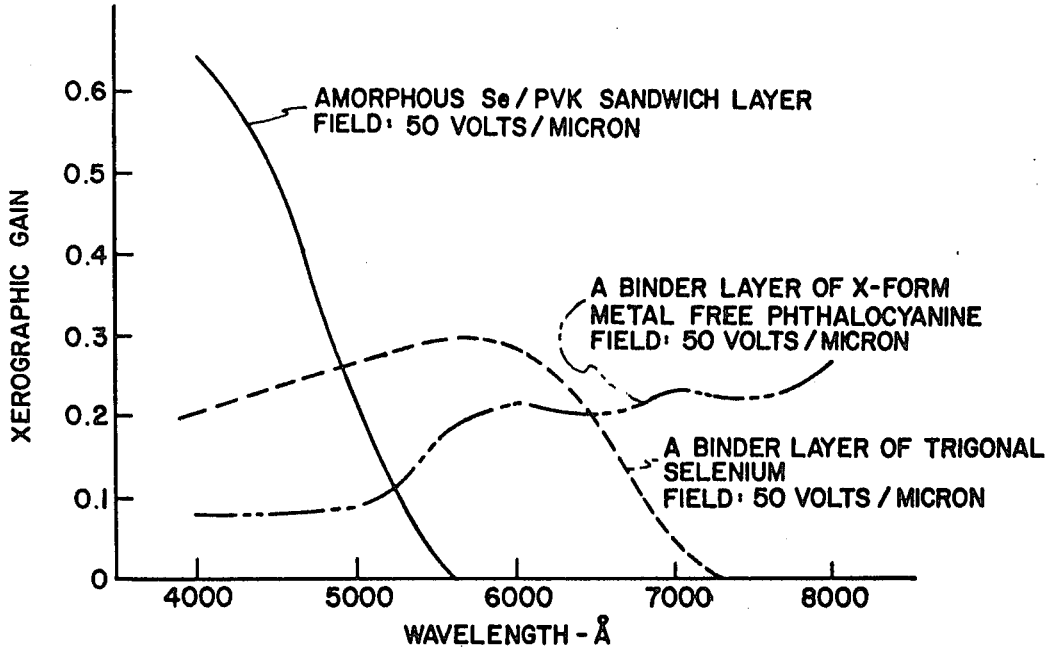
FIG. 5 illustrates the spectral response for three photoconductor materials.
Figure 6:
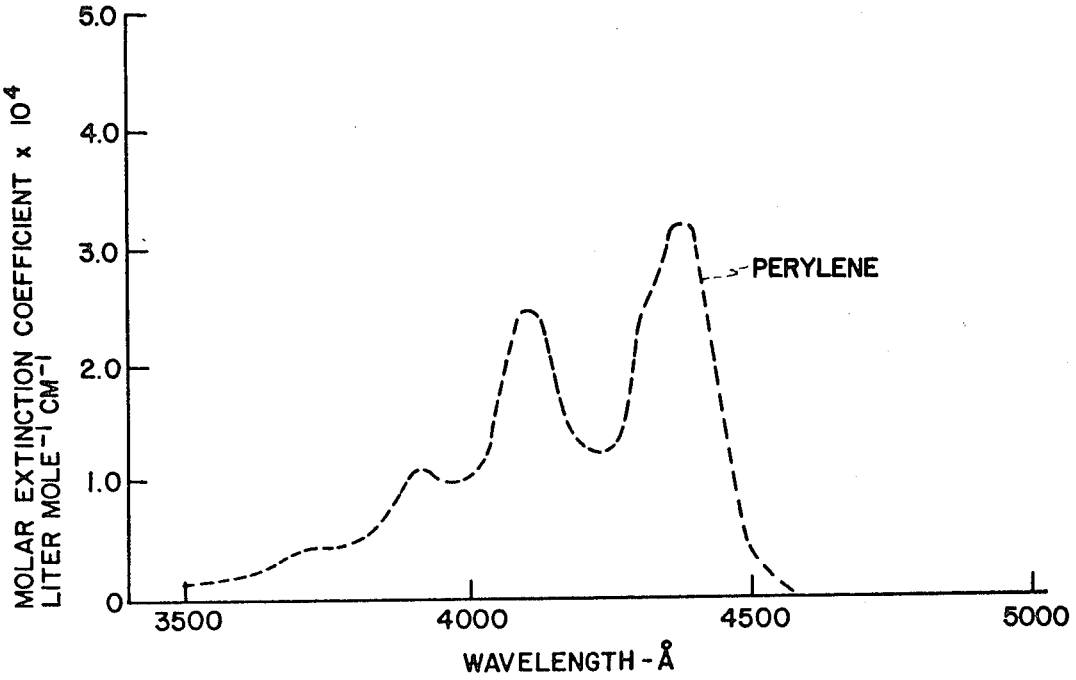
FIG. 6 represents a plot of the absorption spectrum for perylene.

FIGS. 3, 4 and 6 represent the well known absorption coefficient for active materials polyvinyl carbazole, pyrene, and perylene, respectively. FIG. 5 represents the xerographic response spectra for three typical photoconductor-active material combinations. The amorphous selenium-PVK response is for a 0.4 micron layer of amorphous selenium contained on a 20 micron layer of PVK. The X-form of metal free phthalocyanine and trigonal selenium are contained in a polyvinyl carbazole binder in a concentration of about 30 to 1 (by volume) for the phthalocyanine and about 100 to 1 (by volume) for the trigonal selenium. The binder configurations containing the X-form of metal free phthalocyanine and trigonal selenium in PVK are more fully described in applicants' copending application entitled "Binder Imaging Member and Method" filed concurrently with the instant application. Both binder layers are about 20 microns in thickness. As can be seen from FIGS. 3, 4, 5 and 6, it may be deduced that certain combinations of active materials and various photoconductors would be of particular use for selective spectral response.

Figure 7:
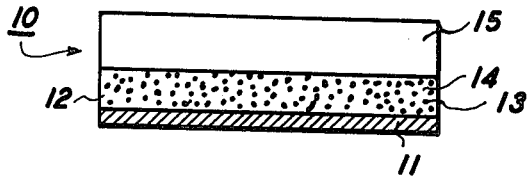
FIG. 7 is a schematic illustration of one embodiment of a device of the instant invention.

Referring to FIG. 7 reference character 10 designates an imaging member in the form of a plate which comprises a supporting substrate 11 having a binder layer 12 thereon, and an active layer 15 positioned over binder layer 12. Substrate 11 is preferably made up of any suitable conductive material. Typical conductors comprise aluminum, steel, brass or the like. The substrate may be rigid or flexible and of any convenient thickness. Typical substrates include flexible belts or sleeves, sheets, webs, plates, cylinders, and drums. The substrate or support may also comprise a composite structure such as a thin conductive coating contained on a paper base; a plastic coated with a thin conductive layer such as aluminum or copper iodide; or glass coated with a thin conductive coating of chromium or tin oxide.

Binder layer 12 contains photoconductive particles 13 dispersed randomly without orientation in a binder 14. The photoconductive particles may consist of any suitable inorganic or organic photoconductor and mixtures thereof. Inorganic materials include inorganic crystalline compounds and inorganic photoconductive glasses. Typical inorganic crystalline compounds include cadmium sulfoselenide, cadmium selenide, cadmium sulfide, and mixtures thereof. Typical inorganic photoconductive glasses include amorphous selenium, and selenium alloys such as selenium-tellurium, and selenium-arsenic. Selenium may also be used in a crystalline form known as trigonal selenium. Typical organic photoconductive materials include phthalocyanine pigments such as the X-form of metal free phthalocyanine described in U.S. Pat. No. 3,357,989 to Byrne et al, metal phthalocyanines, such as copper phthalocyanine; quinacridones available from DuPont under the Tradename Monastral Red, Monastral Violet, and Monastral Red Y; substituted 2,4-diamino-triazines disclosed by Weinberger in U.S. Pat. No. 3,445,227; triphenodioxazines disclosed by Weinberger in U.S. Pat. No. 3,442,781; polynuclear aromatic quinones available from Allied Chemical Corp. under the Tradename Indofast Double Scarlet, Indofast Violet Lake B, Indofast Brilliant Scarlet, and Indofast Orange. The above list of photoconductors should in no way be taken as limiting, but is merely illustrative of suitable materials. The size of the photoconductive particles is not particularly critical, but particles in a size range of about 0.01 to 1.0 microns yield particularly satisfactory results.

The binder material 14 may comprise any electrically insulating resin such as those disclosed in the above mentioned Middleton et al U.S. Pat. No. 3,121,006 or any suitable active material which may be the same or different from that used for layer 15. When using an electrically inactive or insulating resin it is essential that there be particle-to-particle contact between the photoconductive particles. This necessitates that the photoconductive material be present in an amount of at least about 25 percent by volume of the binder layer with no limitation on the maximum amount of photoconductor in the binder layer. If the matrix or binder comprises an active material, the photoconductive material need only comprise about 1 percent or less by volume of the binder layer with no limitation on the maximum amount of photoconductor in the binder layer. The thickness of the photoconductive layer is not critical. Layer thicknesses from about 0.05 to 20 microns have been found satisfactory, with a preferred thickness of about 0.2 to 5 microns yielding good results.

Active layer 15 may comprise any suitable transparent organic polymer or nonpolymeric material capable of supporting the injection of photo-excited holes from the photoconductive layer and allowing the transport of these holes through the organic layer to selectively discharge a surface charge. Polymers having this characteristic have been found to contain repeating units of a polynuclear aromatic hydrocarbon which may also contain heteroatoms such as, for example, nitrogen, oxygen, or sulfur. Typical polymers include poly-N-vinyl carbazole (PVK), poly-1-vinyl pyrene (PVP), poly-9-vinyl anthracene, polyacenaphthalene, poly-9-(4-pentenyl)-carbazole, poly-9-(5-hexyl)-carbazole, polymethylene pyrene, poly-1-(-αpyrenyl)-butadiene and N-substituted polymeric acrylic acid amides of pyrene. Also included are derivatives of such polymers including alkyl, nitro, amino, halogen, and hydroxy substituted polymers. Typical examples are poly-3-amino carbazole, 1,3-dibromo-poly-N-vinyl carbazole and 3,6-dibromo-poly-N-vinyl carbazole in particular derivatives of the formula

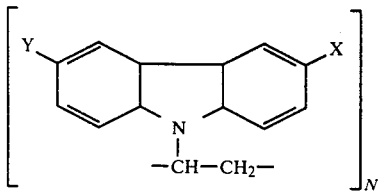

where X and Y are substituents and N is an integer. Also included are structural isomers of these polymers, typical examples include poly-N-vinyl carbazole, poly-2-vinyl carbazole and poly-3-vinyl carbazole. Also included are co-polymers; typical examples are N-vinyl carbazole/methyl acrylate co-polymer and 1-vinyl pyrene/butadiene ABA, and AB block polymers. Typical nonpolymeric materials include carbazole, N-ethylcarbazole, N-phenylcarbazole, pyrene, tetraphene, 1-acetylpyrene, 2,3-benzochrysene, 6,7-benzopyrene, 1-bromopyrene, 1-ethylpyrene, 1-methylpyrene, perylene, 2-phenylindole, tetracene, picene, 1,3,6,8-tetraphenylpyrene, chrysene, fluorene, fluorenone, phenanthrene, triphenylene, 1,2,5,6-dibenzanthracene, 1,2,3,4-dibenzanthracene, 2,3-benzopyrene, anthraquinone, dibenzothiophene, and naphthalene and 1-phenylnaphthalene. Due to the poor mechanical properties of the non-polymer materials they are preferably used in conjunction with either an active polymeric material or a non-active polymeric binder. Typical examples include suitable mixtures of carbazole in poly-N-vinyl carbazole as an active polymer and carbazole in a non-active binder. Such non-active binder materials include polycarbonates, acrylate polymers, poly amides, polyesters, polyurethanes, and cellulose polymers.

It should be understood that the use of any polymer (a polymer being a large molecule built up by the repetition of small, simple chemical units) whose repeat unit contains the appropriate aromatic hydrocarbon, such as carbazole, and which supports hole injection and transport, may be used. It is not the intent of the invention to restrict the type of polymer which can be employed as the transport layer. Polyesters, polysiloxanes, polyamides, polyurethanes and epoxies as well as block, random or graft co-polymers (containing the aromatic repeat unit) are exemplary of the various types of polymers which can be employed as the active material. In addition suitable mixtures of active polymers with inactive polymers or non-polymeric materials may be employed. One action of certain non-active material is to act as a plasticizer to improve the mechanical properties of the active polymer layer. Typical plasticizers include epoxy resins, polyester resins, polycarbonate resins, 1-phenyl naphthalene and chlorinated diphenyl.

The active layer not only serves to transport holes, but also protects the photoconductive layer from abrasive or chemical attack and therefore extends the operating life of the photoreceptor imaging member.

In general, the thickness of the active layer should be from about 5 to 100 microns, but thicknesses outside this range can also be used. The ratio of the thickness of the active layer to the photoconductor layer should be maintained from about 2:1 to 200:1, and in some instances as great as 400:1.

In another embodiment of the instant invention, the structure of FIG. 7 is modified to insure that the photoconductive particles are in the form of continuous chains through the thickness of binder layer 12. This embodiment is illustrated by FIG. 8 in which the basic structure and materials are the same as those of FIG. 7, except that the photoconductive particles 13 are in the form of continuous chains.

Alternately, the photoconductive layer may consist entirely of a substantially homogeneous unoriented photoconductive material such as a layer of amorphous selenium, a selenium alloy, or a powdered or sintered photoconductive layer such as cadmium sulfoselenide or phthalocyanine. This modification is illustrated by FIG. 9 in which a photosensitive member 30 comprises a substrate 11, having a homogeneous photoconductive layer 16, with an overlaying active organic layer 15.

Figure 8:
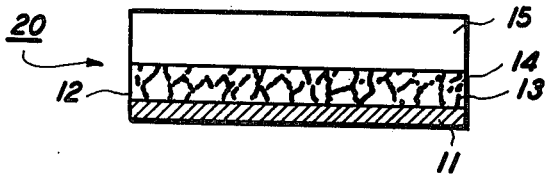
FIG. 8 illustrates a second embodiment of a device for the instant invention.
Figure 9:
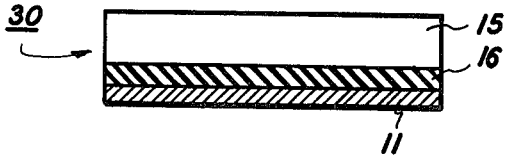
FIG. 9 illustrates a third embodiment of a device of the instant invention.
Figure 10:
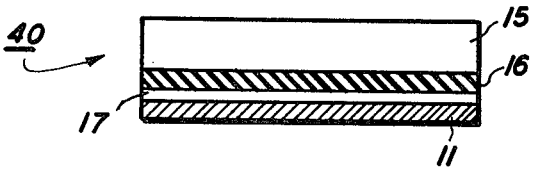
FIG. 10 illustrates a fourth embodiment of a device of the instant invention.

Another modification of the layered configurations described in FIGS. 7, 8 and 9 includes the use of a blocking layer 17 at the substrate-photoconductor interface. This configuration is illustrated by photosensitive member 40 in FIG. 10 in which the substrate 11, and photoconductive layer 16 are separated by a blocking layer 17. The blocking layer functions to prevent the injection of charge carriers from the substrate into the photoconductive layer. Any suitable blocking material may be used. Typical materials include nylon, epoxy, and aluminum oxide.

As stated above, the photoconductor material, whether it be in the form of a pigment or as a homogeneous layer, is employed in an unoriented manner. By unoriented, it is meant that the pigment or photoconductive layer is isotropic with respect to the exciting electromagnetic radiation, i.e., it is equally sensitive to any polarization of the exciting radiation.

In general, the structure of the device of the instant invention requires that the photoconductor and active organic material be selected or matched to provide for the active layer to be non-absorbing to light in the wavelength region used to generate photo-excited carriers in the photoconductive layer. This preferred range for xerographic utility is from about 4000–8000 Angstrom Units. In addition, the photoconductor should be responsive to all wavelengths from 4000 to 8000 Angstroms Units if panchromatic response is required. All photoconductor-active material combinations of the instant invention result in the injection and subsequent transport of holes across the physical interface between the photoconductor and active material.

Although the active material may comprise any suitable polymer or nonpolymeric material having the required properties, polymeric materials are preferred in that their physical properties, such as flexibility, are generally superior to the physical properties of the nonpolymeric materials.

In order to demonstrate the improvement provided by the instant invention over the particular binder layers disclosed in the Middleton et al U.S. Pat. No. 3,121,006, the following tests are carried out. Three typical resin binder materials disclosed by U.S. Pat. No. 3,121,006 to Middleton et al are tested in order to determine the characteristics of these resins in comparison with the active materials of the instant invention. The resins include polystyrene, polyisobutylmethacrylate, and a silicone resin available under the Tradename SR-82 from General Electric. The results of the test demonstrate that these resin binder materials cannot support any practically useful level of charge displacement when used with a vitreous selenium photoreceptor. The polyisobutylmethacrylate and silicone resins are tested in a layered plate configuration by first forming a thin nylon blocking layer about 0.1 microns thick over two 4×4 inch aluminum substrates from a liquid solution using conventional coating techniques. A 1.0 micron layer of each resin respectively, is then formed over the blocking layers of the two plates. A 0.5 micron layer of vitreous selenium is then formed over the resin layers by vacuum evaporation. A third plate is formed by the above method using polystyrene as the resin layer without a nylon blocking layer.

The three plates are each tested by charging to a known potential, illuminating the charged layer, and measuring the residual potential. If there is no charge displacement across the plastic layer then the residual potential can be calculated from the known properties of the resin, the thickness of the layers, the dielectric constant of the materials, and the initial potential. The calculated residual potential should be the same as the measured residual, with experimental error, until the electrical breakdown point of the plastic layer occurs. If it is assumed that the initial field distribution is capacitive, then the residual potential, $V_{res}$, will be defined by the following formula:

$$V_{res} = \frac{V_o}{1 + \frac{k_1 d_2}{k_2 d_1}}$$

If no charge is transported across the resin layer, the plot of the experimental $V_{res}$ should be proportional to $V_o$ (the initial applied potential) with a slope of $$\frac{1}{\left[1 + \frac{k_1 d_2}{k_2 d_1}\right]}$$

In the above formula, the dielectric constant of the resin is $k_1$ and the resin thickness $d_1$, the selenium dielectric constant is $k_2$, the selenium thickness $d_2$. The initial applied voltage is $V_o$.

The experiments are carried out using a monochromatic light source of 4000 Angstroms at an intensity of $2\times10^{12}$ photons/cm$^2$/sec. Each plate is charged to a series of selected voltages between about 0 to 100 volts (about 0 to 65 volts/microns). The residual potential is not limited by the incident light flux since under all conditions of the experiment enough light is used to generate a sufficient number of carriers in the selenium to reduce the field across the selenium layer essentially to zero. The thicknesses of the layers are kept intentionally small, even though thin samples present some measurement problems, in order to approximate the actual situation in binder structure photoreceptors, where the electrical properties of the thin films of plastic between the pigment particles are controlling. The results of these calculations and experiments are set forth in Table 1 below:

TABLE I

Electrical Properties of Layered Structures

| | k | d | Experimental Slope | Calculated Slope |
|---|---|---|---|---|
| Polystyrene | 2.4 | 1.0 | 0.77 (±) 0.01 | 0.83 |
| Polyisobutylmethacrylate | 2.7 | 1.0 | 0.79 (±) 0.02 | 0.82 |
| Silicone Resin | 2.8 | 1.0 | 0.70 (±) 0.02 | 0.81 |
| Selenium | 6 | 0.5 | | |

The values for the experimental slope are calculated using the Method of Least Squares from the experimental data points. The Method of Least Squares is fully described by J. Topping in the book, *Errors of Observation And Their Treatment* published by Reinhold Publishing Corp. of New York, 1955. The small standard error of the slopes indicate that the data points do not scatter significantly about the best straight line. The comparison between the experimental and calculated or theoretical slope must next be considered. Although the experimental and calculated slopes are exactely the same, they compare favorably when all the errors are considered. Although the random errors of the measurements are small (i.e., the standard error of the slope), large systematic errors can arise because of the difficulty in making thickness measurements of the layers.

It may, therefore, be concluded from the experimental data in Table 1 that there is a negligible amount of charge displacement through the three resin layers, even when their thickness is only 1 micron, up to fields about 45 volts/micron. At fields exceeding about 45 volts/micron, these thin layers exhibit dielectric breakdown. This experimental test does not show whether this lack of charge displacement derives from an inability to support hole injection from vitreous selenium or from a very small hole transport range. When all the error limits are considered, it is safe to say that these plastics act as insualtors under the experimental conditions; that is, the charge is either not injected from the selenium into the plastic or, if injected, not transported through the plastic at these fields.

In order to show the advantages of the instant invention with respect to the prior art which uses a combination of at least two or more photosensitive materials, such as U.S. Pat. No. 3,121,007 to Middleton and U.S. Pat. No. 3,037,861 to Hoegl et al, additional tests are carried out. If during use, the active matrix material of the instant invention absorbs some of the incident exposure illumination, the photoreceptor, whether it be in particulate form in a binder or as a separate photoinjecting layer, becomes less sensitive. In addition to a decrease in discharge sensitivity, the utilization of the photoconductive nature of the active matrix material leads to serious problems in continuous use such as in copy machine cycling. Normally it is desirable that a photoreceptor have stable or constant electrical properties during cycling to allow for proper design of other components in the system such as, for example, development, exposure and background control. If these conditions cannot be maintained substantially constant, it becomes difficult, if not impossible, to design a reliable automatic copy machine that does not require constant servicing and adjustments. In order to demonstrate the criticality of imaging structures of the instant invention only within wavelengths in which charge carriers are generated by the photoconductor, and to which the surrounding matrix or active material is substantially transparent, the following test is carried out.

A plate is made for test purposes. The plate comprises a conductive tin oxide coated quartz substrate. A 0.1 micron epoxy blocking layer is formed over the tin oxide, followed by a 0.5 micron layer of amorphous selenium which is formed by vacuum evaporation. A 10 micron coating of PVK is then formed over the selenium layer. In order to illustrate the fact that the active matrix material should be transparent to radiation in order to attain maximum efficiency for the device, the following test is carried out:

The plate is charged to a negative potential of about 200 volts and tested at four different wavelengths by exposure through the top surface of the PVK layer. Upon illumination, through the top, the plate exhibits a characteristic electrical discharge curve. The xerographic speed of the plate can be compared by determining graphically the slope of the discharge curve at the instant of illumination, i.e., (dV/dt) at t=o, normalized to the thickness of the sample and to incident flux of $1\times10^{12}$ photons/cm$^2$/sec. This calculation is defined as the discharge sensitivity and is shown in Table II below:

TABLE II

Dependence of Discharge Rate on Absorption by PVK

| Wavelength Å | $V_o$ (Volts) | $(dV/dt)_{t=o}$ (volts/sec) |
|---|---|---|
| 4000 | 205 | 157 |
| 3550 | 185 | 83 |
| 3340–3370 | 200 | 75 |
| 3150–3180 | 200 | 45 |
| 2720–2740 | 195 | 49 |

As seen from the data in Table II, at 4000 Å, where the PVK is substantially transparent to the exposure illumination, the discharge sensivity [(dV/dt) t=o] is relatively high. When exposing to wavelengths of 3550 or less, however, some charge carriers are generated in the PVK, and the sensivity is significantly reduced.

In order to demonstrate the criticality of continuous repetitive use or cycling, and the necessary requirement that the active matrix material be transparent to the illuminating or exposure radiation, additional tests are carried out. A 4×4 inch aluminum substrate is first coated with a 0.2 micron layer of epoxy to form a blocking layer, a 0.5 micron layer of vitreous selenium is then formed over the blocking layer by vacuum deposition, the selenium layer is then overcoated with a 12 micron layer of PVK. This plate structure is then taped to an 8 inch diameter aluminum drum, charged to a negative potential of 900 volts, and exposed to light to obtain 200 volts of contrast potential. The plate is then erased to a negative potential of 40 volts or less by exposure with a quartz iodine lamp, and charged again to 900 volts negative potential. The cycle is then repeated at a peripheral drum speed of about six inches per second. For all tests, the starting potential is adjusted to 900 volts by adjusting the corona current at the beginning of the test. The experiments were carried out at exposures of 4000, 3450, and 2537 Angstroms, respectively. In each case, the intensity is adjusted at the beginning to create 200 volts of contrast potential. The results of the test are illustrated in FIG. 11.

Figure 11:
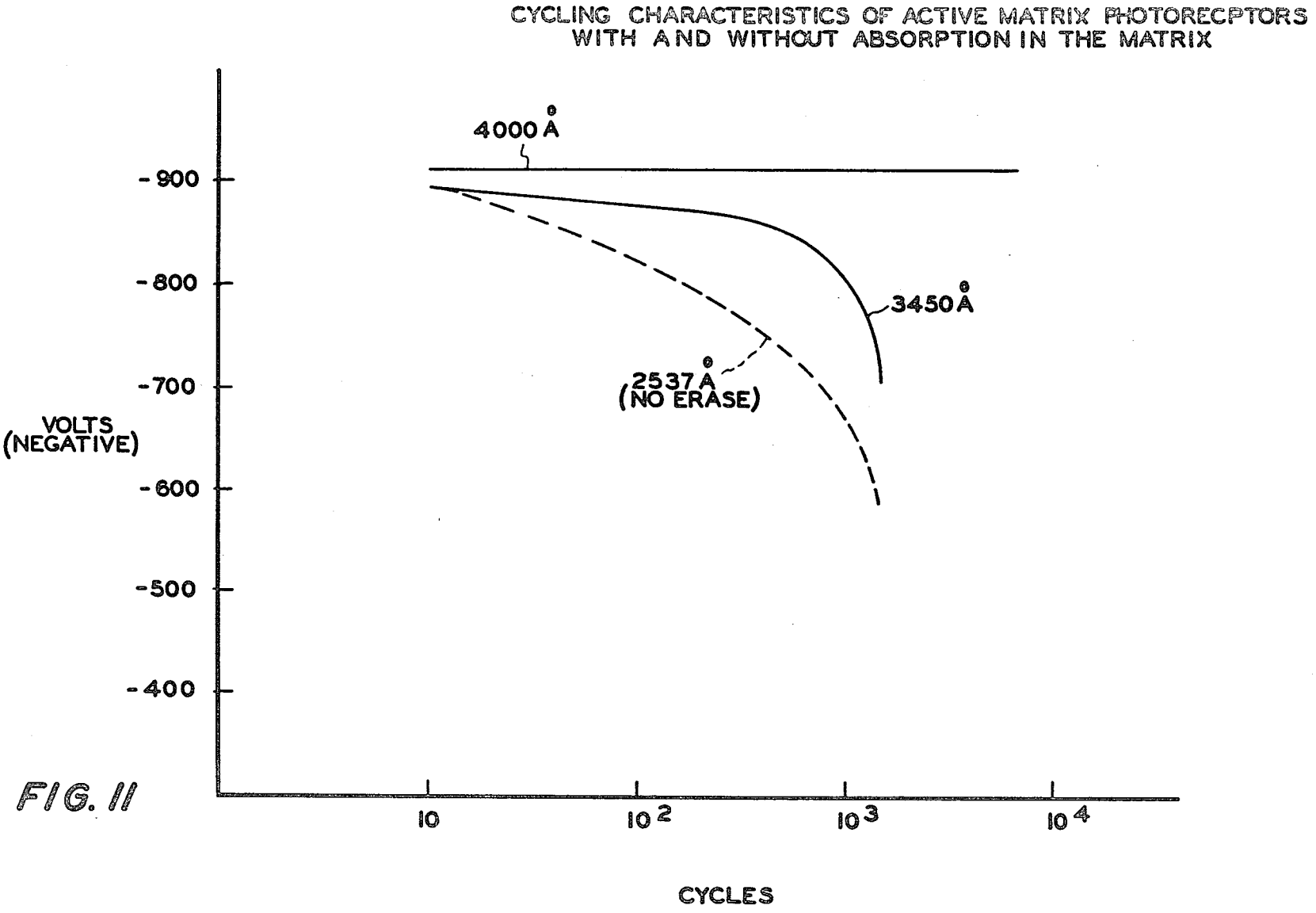
FIG. 11 illustrates the cycling characteristics at various exposure wavelengths for a device of the instant invention.

As shown in FIG. 11, at 4000 Angstroms, where the PVK is transparent to the incident light and not being used as a photoconductor, the structure is stable in its electrical characteristics for more than 1000 cycles. However, for 3450 Angstroms, and 2537 Angstroms, where the incident light is strongly absorbed by the PVK layer, and the PVK is being used as a photoconductor, the initial potential decreases upon cycling, and by extrapolation, the photoreceptor would probably not even accept charge at about 10,000 cycles. Over the range of these experiments, the potential after exposure decreased in proportion to the decrease in initial potential, resulting in a constant contrast potential. Although it would be possible to develop such an image, the change in potential with constant contrast would lead to difficulties in development and background control and be unsuitable for automatic cycling in the xerographic mode.

DESCRIPTION OF THE PREFERRED EMBODIMENTS

The following examples further specifically define the present invention with respect to a method of making a photosensitive member containing a photoconductive layer contiguous with active organic layer. The percentages are by weight unless otherwise indicated. The examples below are intended to illustrate various preferred embodiments of the instant invention.

EXAMPLE I

A plate or layered structure similar to that illustrated in FIG. 7 consisting of a 22 micron layer of polyvinyl carbazole (PVK) [Luvican M170 grade poly-N-vinylcarbazole available from BASF] coated on top of a 6 micron binder layer consisting of a 6/1 by weight (7.5/1 by volume) PVK/X-form of metal free phthalocyanine dispersion deposited on a 5 mil aluminum substrate is prepared as follows:

(1) A 16.7% polymer stock solution is prepared by dissolving the appropriate amount of PVK in a solution of 180 grams of toluene and 20 grams cyclohexanone.

(2) 0.5 grams of X-form metal free phthalocyanine are mixed with 18 grams of the PVK stock solution and 5 ml. of toluene. This mixture is mixed in a ball mill for about 15 minutes to form a uniform well dispersed suspension.

(3) The dispersion is then coated onto the aluminum substrate using a Gardner Laboratory's Bird Applicator to form a layer 6 microns thick after drying at 110° C. in an air oven for 1 hour.

(4) A 22 micron PVK layer is formed by applying the stock solution of PVK to the phthalocyanine binder layer using the Bird Applicator. Finally the total configuration is air dried at 110° C. for 12 hours.

A visible image is formed by uniformly corona charging the plate in the dark to a negative field of about 20 to 40 volts per micron, followed by exposing the charged plate to a pattern of light from a tungsten light source to form a latent electrostatic image. The tungsten light source is filtered to eliminate all radiation below about 4000 Angstroms Units. The latent image is developed by cascading the plate with Xerox 914 toner particles to form a toner image which is transferred to a sheet of paper where the toner particles are fixed to form a permanent copy.

EXAMPLE II

A second plate is prepared by the method of Example I except that instead of using phthalocyanine, Indofast Orange, a polynuclear aromatic quinone available from Allied Chemical Corp., is used as the photoconductor. The photoconductive layer is about 2 microns thick, and the PVK overlayer about 13 microns in thickness. A visible image is formed as in Example I above.

EXAMPLE III

A third plate similar to that illustrated in FIG. 9 is prepared by the method of Example I except that amorphous selenium is used as the photoconductor. In this case the photoconductor layer is applied by conventional vacuum deposition techniques such as those disclosed by Bixby in U.S. Pat. Nos. 2,753,278 and 2,970,906. The selenium is formed in a thickness of about 0.5 micron. To prevent crystallization of the selenium, the PVK top layer is air dried at room temperature for about 1 hour after which time it is dried in a vacuum for about 12 hours at room temperature, and for an additional 24 hours at 40° C. This plate is capable of retaining an electrostatic charge in the dark, and dissipating the charge upon exposure to activating radiation.

EXAMPLE IV

A fourth plate is prepared by the method of Example III except that poly-1-vinylpyrene (PVP) is substituted as the top layer. In this example, the polymer is synthesized according to the method outlined for the cationic polymerization of Sorenson and Campbell's "Preparative Methods of Polymer Chemistry", 1968 Edition, page 267. Five grams of PVP are dissolved in chloroform to make a 10% solution. This solution is then coated over the selenium layer to form a dried layer about 15 microns thick. A visible image is formed on the plate using the method of Example I.

EXAMPLE V

A plate is prepared by the method of Example IV except that the active layer consists of a 10 micron thick layer of a pyrene-formaldehyde condensation polymer. Preparation of the polymer is according to British Pat. No. 1,021,994. By dissolving about 5 grams of the polymer in 50 grams of chloroform a suitable overcoating solution is prepared. This plate is capable of retaining an electrostatic charge in the dark and dissipating the charge upon exposure to radiation at a wavelength centered at about 4500 Angstrom Units.

EXAMPLE VI

A plate is prepared by the method of Example V except that an N-substituted polymeric acrylic acid amide of pyrene is used whose nitrogen substituent is pyrene. Synthesis of this polymer is outlined in U.S. Pat. No. 3,307,940. This plate is capable of retaining an electrostatic charge and dissipating the charge upon exposure to radiation at a wavelength centered at about 4500 Angstroms Units.

EXAMPLE VII

A plate is prepared by the method of Example III except that a 50 micron evaporated polycrystalline layer of pyrene is used as the active material. An aluminum plate containing a 0.5 micron evaporated layer of amorphous selenium is placed in a vacuum bell jar maintained at a vacuum of about $10^{-6}$ Torr. with the selenium layer facing the pyrene source. To prevent crystallization of the selenium during the pyrene evaporation, the temperature of the selenium containing aluminum plate is maintained below 10° C. by means of a water cooling block designed into the vacuum system. The pyrene is evaporated by heating to about 100° C. for about one hour resulting in a uniform transparent sheet of pyrene being formed over the selenium layer. The plate is capable of retaining an electrostatic charge in the dark and dissipating the charge upon exposure to radiation at a wavelength centered at about 4500 Angstrom Units.

EXAMPLE VIII

A plate is prepared by the method of Example VII except that a transparent sheet of polycrystalline tetraphene 20 microns in thickness is substituted for the pyrene. This plate is capable of retaining an electrostatic charge in the dark and dissipating the charge upon exposure to radiation at a wavelength centered at about 4500 Angstrom Units.

EXAMPLE IX

A series of 9 plates are made by the method of Example VIII except that the following 9 polycyclic aromatic compounds are used as the active layer, with a 0.5 vitreous selenium layer used as the photoconductor layer in each case:

(1) 1-acetylpyrene
(2) 2,3-benzochrysene
(3) 6,7-benzopyrene
(4) 1-bromopyrene
(5) carbazole
(6) 1-ethylpyrene
(7) 1-methylpyrene
(8) perylene
(9) 2-phenylindole The top layer of the active material is about 20 microns in thickness. Each of the plates is then imaged by the method of Example I to form a visible image. The plate having the perylene layer was imaged by filtering out radiation below about 4500 Angstrom Units. The development of the latent image is carried out by magnetic brush development as set forth by Young in U.S. Pat. No. 2,786,439.

EXAMPLE X

A plate is prepared by the method of Example I except that a 0.5 micron nylon layer is used as the blocking layer. The nylon used is sold by DuPont under the tradename "Zytel". The blocking layer is formed by dip coating the plate in a solution of nylon dissolved in methyl alcohol.

EXAMPLE XI

A plate is prepared by the method of Example III except a 0.5 micron epoxy layer is used as the blocking layer. A coating slurry is formed by mixing 355 grams of epoxy sold by Shell Oil under the tradename Epon-1007, 200 grams of resin 5210 available from the Resyn Corp. and 44 grams of Uformite F-240 available from Rohms & Hass Co. This mixture is then diluted in 403 grams of the solvent Ethyl Cellosolve, available from Union Carbide, to form a coating slurry. The blocking layer is formed by dip coating the plate in the epoxy slurry to form a dried thickness of 0.5 microns.

EXAMPLE XII

A plate is prepared by the method of Example III except that a nylon blocking layer identical to that of Example X is formed between the selenium layer and substrate. Each of the plates formed in Examples X–XII is capable of accepting and retaining an electrostatic charge in the dark, and dissipating the charge upon exposure to activating radiation.

EXAMPLE XIII

A xerographic plate is made as follows: 1 part of a quinacridone pigment (DuPont Monostral Red B) is dispersed in 1 part PVK (from a 17% PVK solution) and 10 parts of toluene. This dispersion is milled with steel shot for ½ hour on a paint shaker. A 3–5 micron thick layer of this dispersion is then coated onto an aluminum substrate. A layer of PVK about 50 microns thick is then formed on the pigment layer using the method of Example I. The plate is tested electrically by charging negatively and discharging with white light. The plate exhibits good charge acceptance and photodischarge. Prints were made from the plate using the method of Example I.

Four additional plates were made using the methods of Examples I and III. These plates exhibit good charge acceptance and photoresponse. In addition, each plate was used to form a visible image by the method set forth in Example I, except that magnetic brush development was used instead of cascade developement.

TABLE III

| Active Overlayer Material | Active Overlayer Thickness | Photoconductor Layer Material | Photoconductor Layer Thickness | Substrate |
|---|---|---|---|---|
| PVK | 8 microns | 96/1 by volume PVK-Trigonal Selenium | 4 microns | Aluminum |
| PVK | 13 microns | 7.5/1 by volume PVK-X-form of metal free phthalocyanine | 3 microns | 1 micron nylon blocking layer on aluminum |
| PVP | 12 microns | Vitreous selenium | 0.5 microns | 0.2 micron nylon blocking layer on aluminum |
| PVP | 20 microns | Vitreous selenium | 0.5 microns | Aluminum |

The plates of Examples I, II, IV, and VII are electrically tested to determine xerographic gain (G) at a wavelength exposure of high response. The electrical data and calculated gain for each plate is tabulated in Table IV. The plates of Table IV are electrostatically charged to a negative potential (a field of $50\times10^4$ volts/cm. represents a voltage of $50\times10^4$ volts for each cm. of layer thickness) using a corona charging device. Each sample was then exposed to monochromatic light of wavelength near the peak absorption for the photoconductor being used. The resulting discharge (voltage versus time) are then recorded. From this data the xerographic gain is then calculated using the formula set forth above.

TABLE IV

| Plate of Example | Wavelength Exposure in Angstrom Units | Photon Flux (Photons/$Cm^2$Sec.) | Field Range Tested ($V/Cm\times10^4$) | Gain or Max Efficiency (Charge Carriers Collected Per Absorbed Photon) |
|---|---|---|---|---|
| I | 6200 | $8.6\times10^{12}$ | 2–90 | .35 |
| II | 4540 | $3.3\times10^{12}$ | 3–70 | .12 |
| IV | 4000 | $2.0\times10^{12}$ | 0.4–55 | .53 |
| VII | 4000 | $2.1\times10^{12}$ | 1–15 | .20 |

Although specific components and proportions have been stated in the above description of the preferred embodiments of the instant invention, other suitable materials and procedures such as those listed above may be used with similar results. In addition, other materials and modifications may be utilized which synergize, enhance or otherwise modify the photosensitive member and method of use. For example, when using a transparent substrate such as a plastic coating with a thin conductive coating of aluminum or tin oxide, the structure may be imaged by exposure through the substrate. In addition, if desired, an electrically insulating substrate may also be used. In this instance, the charge may be placed upon the imaging member by double corona charging techniques well known and disclosed in the art. Other modifications using an insulating substrate or no substrate at all, include placing the imaging member onto a conductive backing member or platen and charging the surface while in contact with said backing member. Subsequent to imaging, the imaging member may then be stripped from the conductive backing.

Other modifications and ramifications of the present invention would appear to those skilled in the art upon reading the disclosure. These are also intended to be within the scope of the invention.

What is claimed is:

1. An imaging member comprising a layer of unoriented inorganic photoconductive material contained on a supporting substrate and a contacting layer of an electrically active organic material overlaying the photoconductive layer, with the ratio of the thickness of the active layer to the photoconductive layer being maintained from about 2:1 to 200:1, said photoconductive layer being at least about 0.05 micron thick and exhibiting the capability of photo-excited hole generation and injection, said active organic material being capable of supporting the injection of photo-excited holes from said photoconductive layer and transporting said holes through said active layer, wherein said active layer comprises at least one material selected from the group consisting of poly-1-vinylpyrene, polymethylene pyrene, N-substituted polymeric acrylic acid amides of pyrene, pyrene, tetraphene, 1-acetylpyrene, 2,3-benzochrysene, 6,7-benzopyrene, 1-bromopyrene, 1-ethylpyrene 1-methylpyrene, perylene, 2-phenylindole, tetracene, picene, 1,3,6,8-tetraphenylpyrene, chrysene, fluorene, fluorenone, phenanthrene, triphenylene, 1,2,5,6-debanzanthracene, 1,2,3,4-dibenzanthracene, 2,3-benzopyrene, 2,3-benzochrysene, anthraquinone, dibenzothiophene, and naphthalene.

2. The member of claim 1 in which the photoconductive layer comprises inorganic photoconductive particles dispersed in a binder.

3. The member of claim 1 in which the substrate is electrically conductive.

4. The member of claim 3 in which the photoconductive layer is contained on a substantially transparent supporting substrate.

5. The member of claim 1 in which the photoconductive layer comprises at least one material selected from the group consisting of vitreous selenium, a selenium alloy, trigonal selenium and cadmium sulfoselenide.

6. An imaging member comprising a layer of unoriented inorganic photoconductive material contained on a supporting substrate and a contacting layer of an electrically active organic material overlaying the photoconductive layer, with the ratio of the thickness of the active layer to the photoconductive layer being maintained from about 2:1 to 200:1, said photoconductive layer being at least about 0.05 micron thick and exhibiting the capability of photo-excited hole generation and injection, said active organic material being capable of supporting the injection of photo-excited holes from said photoconductive layer and transporting said holes through said active layer, wherein said active layer comprises at least one material selected from the group consisting of poly-N-vinyl carbazole, poly-1-vinyl pyrene, poly-9-vinyl anthracene, polyacenaphthalene, poly-9-(4-pentenyl)-carbazole, poly-9-(5-hexyl)-carbazole, polymethylene pyrene, poly 1-(-αpyrenyl)-butadiene, N-substituted polymeric acrylic acid amides of pyrene, poly-3-amino carbazole, 1,3-dibromo-poly-N-vinyl carbazole, 3,6-dibromo-poly-N-vinyl carbazole, poly-2-vinyl carbazole, poly-3-vinyl carbazole, N-vinyl carbazole/methyl acrylate copolymers, 1-vinyl pyrene/butadiene ABA, and AB block polymers, carbazole, N-ethylcarbazole, N-phenylcarbazole, pyrene, tetraphene, 1-acetylpyrene, N-benzochrysene, 6,7-benzopyrene, 1-bromopyrene, 1-ethylpyrene, 1-methylpyrene, perylene, 2-phenylindole, tetracene, picene, 1,3,6,8-tetraphenylpyrene, chrysene, fluorene, fluorenone, phenanthrene, triphenylene, 1,2,5,6-dibenzanthracene, 1,2,3,4-dibenzanthracene, 2,3-benzopyrene, 2,3-benzochrysene, anthraquinone, dibenzothiophene, naphthalene and 1-phenylnaphthalene.

7. The member of claim 1 in which the electrically active organic material is blended or mixed with a non-active polymeric material.

8. The member of claim 1 in which the electrically active organic material is blended or mixed with a plasticizer.

9. A method of imaging which comprises:

(a) providing an imaging member having at least two adjacent layers comprising a layer of unoriented inorganic photoconductive material contained on a supporting substrate and a contacting layer of an electrically active organic material overlaying the photoconductive layer, with the ratio of the thickness of the active layer to the photoconductive layer being maintained from about 2:1 to 200:1, said photoconductive layer being at least about 0.05 micron thick and exhibiting the capability of photo-excited hole generation and injection, said active organic material being capable of supporting the injection of photo-excited holes from said photoconductive layer and transporting the holes through said active layer, wherein said active layer comprises at least one material selected from the group consisting of poly-1-vinylpyrene, polymethylene pyrene, N-substituted polymeric acrylic acid amides of pyrene, pyrene, tetraphene, 1-acetylpyrene, 2,3-benzochrysene, 6,7-benzopyrene, 1-bromopyrene, 1-ethylpyrene, 1-methylpyrene, perylene, 2-phenylindole, tetracene, picene, 1,3,6,8-tetraphenylpyrene, chrysene, fluorene, fluorenone, phenanthrene, triphenylene, 1,2,5,6-dibenzanthracene, 1,2,3,4-dibenzanthracene, 2,3-benzopyrene, anthraquinone, dibenzothiophene, and naphthalene;

(b) uniformly negatively electrostatically charging the free surface of the active layer, followed by;

(c) exposing said charged layer to a source of activating radiation to which the photoconductive layer is absorbing and to which the active layer is substantially transparent and non-absorbing, the exposure being in the form of a pattern of light and shadow optically projected toward said layer, whereby photo-excited holes generated by said photoconductive layer are injected into and transported through said active layer to form a latent electrostatic image on the free surface of the active layer.

10. The method of claim 9 in which the latent image is developed to form a visible image.

11. The method of claim 9 in which the activating radiation is within the visible spectrum.

12. The method of claim 9 in which the source of activating radiation is in the range of about 4000 to 8000 Angstrom Units.

13. The method of claim 9 in which the substrate is electrically conductive.

14. The subject matter of claim 9 or 1 in which the active layer comprises at least one material selected from the group consisting of poly-N-vinyl carbazole, poly-1-vinyl pyrene, poly-9-anthracene, polyacenaphthalene, poly-9-(4-pentenyl)-carbazole, poly-9-(5-hexyl)-carbazole, polymethylene pyrene, poly 1-(-αpyrenyl)butadiene, N-substituted polymeric acrylic acid amides of pyrene, poly-3-amino carbazole, 1,3-dibromo-poly-N-vinyl carbazole, 3,6-dibromo-poly-N-vinyl carbazole, poly-2-vinyl carbazole, poly-3-vinyl carbazole, N-vinyl carbazole/methyl acrylate copolymers, 1-vinyl pyrene/butadiene ABA, and AB block polymers, carbazole, N-ethylcarbazole, N-phenylcarbazole, pyrene, tetraphene, 1-acetylpyrene, N-benzochrysene, 6,7-benzopyrene, 1-bromopyrene, 1-ethylpyrene, 1-methylpyrene, perylene, 2-phenylindole, tetracene, picene, 1,3,6,8-tetraphenylpyrene, chrysene, fluorene, fluorenone, phenanthrene, triphenylene, 1,2,5,6-dibenzanthracene, 1,2,3,4-dibenzanthracene, 2,3-benzopyrene, 2,3-benzochrysene, anthraquinone, dibenzothiophene, naphthalene and 1-phenylnaphthalene.

15. A method of imaging which comprises:

(a) providing an imaging member having at least two adjacent layers comprising a layer of unoriented inorganic photoconductive material contained on a supporting substrate and a contacting layer of an electrically active organic material overlaying the photoconductive layer, with the ratio of the thickness of the active layer to the photoconductive layer being maintained from about 2:1 to 200:1, said photoconductive layer being at least about 0.05 micron thick and exhibiting the capability of photo-excited hole generation and injection, said active organic material being capable of supporting the injection of photo-excited holes from said photoconductive layer and transporting the holes through said active layer wherein said active layer comprises at least one material selected from the group consisting of polyvinyl carbazole, poly-1-vinylpyrene, polymethylene pyrene, N-substituted polymeric acrylic acid amides of pyrene, carbazole, N-ethyl-carbazole, N-phenylcarbazole, pyrene, tetraphene, 1-acetylpyrene, 2,3-benzochrysene, 6,7-benzopyrene, 1-bromopyrene, 1-ethylpyrene, 1-methylpyrene, perylene, 2-phenylindole, tetracene, picene, 1,3,6,8-tetraphenylpyrene, chrysene, fluorene, fluorenone, phenanthrene, triphenylpyrene, 1,2,5,6-dibenzanthracene, 1,2,3,4-dibenzanthracene, 2,3-benzopyrene, anthraquinone, dibenzothiophene, and naphthalene;

(b) uniformly negatively electrostatically charging the free surface of the active layer followed by;

(c) exposing said charged layer to a source of activating radiation to which the photoconductive layer is absorbing and to which the active layer is substantially transparent and non-absorbing, the exposure being in the form of a pattern of light and shadow optically projected toward said layer, whereby photo-excited holes generated by said photoconductive layer are injected into and transported through said active layer to form a latent electrostatic image on the free surface of the active layer;

(d) developing the latent image to form a visible image;

(e) transferring the visible image to a receiving sheet, and (f) repeating steps (b), (c), and (d) at least one additional time.

16. A method of imaging which comprises:

(a) providing an imaging member having at least two adjacent layers comprising a layer of unoriented inorganic photoconductive material contained on a supporting substrate and a contacting layer of an electrically active organic material overlaying the photoconductive layer, with the ratio of the thickness of the active layer to the photoconductive layer being maintained from about 2:1 to 200:1, said photoconductive layer being at least about 0.05 micron thick and exhibiting the capability of photo-excited hole generation and injection, said active organic material being capable of supporting the injection of photo-excited holes from said photoconductive layer and transporting the holes through said active layer, wherein said active layer comprises poly-N-vinylcarbazole;

(b) uniformly negatively electrostatically charging the free surface of the active layer, followed by:

(c) exposing said charged layer to a source of activating radiation to which the photoconductive layer is absorbing and to which the active layer is substantially transparent and non-absorbing, the exposure being in the form of a pattern of light and shadow optically projected toward said layer, whereby photo-excited holes generated by said photoconductive layer are injected into and transported through said active layer to form a latent electrostatic image on the free surface of the active layer.

17. The imaging member of claim 1 in which the active layer comprises a material selected from the group consisting of a derivative of an alkyl, nitro, amino, halogen and hydroxy substituted polymers.

18. The member of claim 1 in which the photoconductive layer comprises a selenium-tellurium alloy.

19. The member of claim 6 in which the photoconductive layer comprises a selenium-tellurium alloy.

20. An imaging member comprising a layer of unoriented inorganic photoconductive selenium-tellurium contained on a supporting substrate and a contacting layer of electrically active organic material overlaying the photoconductive layer, with the ratio of the thickness of the active layer to the photoconductive layer being maintained from about 2:1 to 200:1, said photoconductive layer being at least about 0.05 micron thick and exhibiting a capability of photoexcited hole generation and injection, said active organic material being capable of supporting the injection of photoexcited holes from said photoconductive layer and transporting said holes through said active layer, wherein said active layer comprises at least one material selected from the group consisting of poly-1-vinylpyrene and poly-N-vinyl carbazole.

21. An electrophotographic plate for producing an electrostatic latent image on the top layer thereof which comprises from the bottom up:

(a) a conductive substrate, (b) a layer of vitreous selenium having a thickness of from 0.05 to 20 microns, (c) a top layer comprising a member selected from the group consisting of poly-N-vinyl-carbazole, poly-1-vinylpyrene, polymethylene pyrene, N-substituted polymeric acrylic acid amides of pyrene, pyrene, tetraphene, 1-acetylpyrene, 2,3-benzochrysene, 6,7-benzopyrene, 1-bromopyrene, 1-ethylpyrene, 1-methylpyrene, perylene, 2-phenylindole, tetracene, picene, 1,3,6,8-tetraphenylpyrene, chrysene, fluorene, fluorenone, phenanthrene, triphenylene, 1,2,5,6-dibenzanthracene, 1,2,3,4-dibenzanthracene, 2,3-benzopyrene, anthraquinone, dibenzothiophene, and naphthalene, said top layer being substantially visible ray transmissive and substantially non-light sensitive in the visible range in the absence of a sensitizer, the sensitizer for said top layer consisting essentially of vitreous selenium layer b.

22. An electrophotographic plate for producing an electrostatic latent image on the top layer thereof which comprises from the bottom up:

a. a conductive substrate;

b. a layer of vitreous selenium, a vitreous selenium/-tellurium alloy, a vitreous selenium/arsenic alloy or phthalocyanine having a thickness of from 0.05 to 20 microns;

c. a top layer comprising a member selected from the group consisting of poly-N-vinyl-carbazole, polyacenaphthylene, poly-9(4-pentenyl) carbazole, poly-9-(5-hexyl)carbazole, poly-3-aminocarbazole, brominated poly-N-vinyl carbazole, copolymers of N-vinylcarbazole and methylacrylate, poly-9-vinylanthracene, poly-1-vinylpyrene, polymethylene pyrene, N-substituted polymeric acrylic acid amides of pyrene, pyrene, tetraphene, 1-acetylpyrene, 2,3-benzochrysene, 6,7-benzopyrene, 1-bromopyrene, 1-ethylpyrene, 1-methylpyrene, perylene, 2-phenylindole, tetracene, picene, 1,3,6,8-tetraphenylpyrene, chrysene, fluorene, fluorenone, phenanthrene, triphenylene, 1,2,5,6-dibenzanthracene, 1,2,3,4-dibenzanthracene, 2,3-benzopyrene, anthraquinone, dibenzothiophene, and naphthalene, said top layer being substantially visible ray transmissive and substantially non-light sensitive in the visible range in the absence of a sensitizer;

the sensitizer for said top layer consisting essentially of vitreous selenium, selenium/tellurium, selenium-/arsenic or phthalocyanine layer b.

23. An electrophotographic plate for producing an electrostatic latent image on the top layer thereof which comprises from the bottom up:

a. a conductive substrate;

b. a layer of vitreous selenium, a vitreous selenium/-tellurium alloy or phthalocyanine having a thickness of from 0.05 to 20 microns;

c. a top layer comprising a member selected from the group consisting of poly-N-vinyl-carbazole, polyacenaphthylene, poly-9(4-pentenyl) carbazole, poly-9-(5-hexyl)carbazole, poly-3-aminocarbazole, brominated poly-N-vinyl carbazole, copolymers of N-vinylcarbazole and methylacrylate, poly-9-vinylanthracene, poly-1-vinylpyrene, polymethylene pyrene, N-substituted polymeric acrylic acid amides of pyrene, pyrene, tetraphene, 1-acetylpyrene, 2,3-benzochrysene, 6,7-benzopyrene, 1-bromopyrene, 1-ethylpyrene, 1-methylpyrene, perylene, 2-phenylindole, tetracene, picene, 1,3,6,8-tetraphenylpyrene, chrysene, fluorene, fluorenone, phenanthrene, triphenylene, 1,2,5,6-dibenzanthracene, 1,2,3,4-dibenzanthracene, 2,3-benzopyrene, anthraquinone, dibenzothiophene, and naphthalene, said top layer being substantially visible ray transmissive and substantially non-light sensitive in the visible range in the absence of a sensitizer;

the sensitizer for said top layer consisting essentially of vitreous selenium, selenium/tellurium or phthalocyanine layer b.

24. An electrophotographic plate for producing an electrostatic latent image on the top layer thereof which comprises from the bottom up:

a. a conductive substrate;

b. a layer of vitreous selenium, a vitreous selenium/-tellurium alloy of a vitreous selenium/arsenic alloy having a thickness of from 0.05 to 20 microns;

c. a top layer comprising a member selected from the group consisting of poly-N-vinyl-carbazole, polyacenaphthylene, poly-9(4-pentenyl) carbazole, poly-9-(5-hexyl)carbazole, poly-3-aminocarbazole, brominated poly-N-vinyl carbazole, copolymers of N-vinylcarbazole and methylacrylate, poly-9-vinylanthracene, poly-1-vinylpyrene, polymethylene pyrene, N-substituted polymeric acrylic acid amides of pyrene, pyrene, tetraphene, 1-acetylpyrene, 2,3-benzochrysene, 6,7-benzopyrene, 1-bromopyrene, 1-ethylpyrene, 1-methylpyrene, perylene, 2-phenylindole, tetracene, picene, 1,3,6,8-tetraphenylpyrene, chrysene, fluorene, fluorenone, phenanthrene, triphenylene, 1,2,5,6-dibenzanthracene, 1,2,3,4-dibenzanthracene, 2,3-benzopyrene, anthraquinone, dibenzothiophene, and naphthalene, said top layer being substantially visible ray transmissive and substantially non-light sensitive in the visible range in the absence of a sensitizer;

the sensitizer for said top layer consisting essentially of vitreous selenium, selenium/tellurium or selenium/arsenic layer b.

25. An electrophotographic plate for producing an electrostatic latent image on the top layer thereof which comprises from the bottom up:

a. a conductive substrate;

b. a layer of vitreous selenium or a vitreous selenium/tellurium alloy having a thickness of from 0.05 to 20 microns;

c. a top layer comprising a member selected from the group consisting of poly-N-vinyl-carbazole, polyacenaphthylene, poly-9(4-pentenyl) carbazole, poly-9-(5-hexyl)carbazole, poly-3-aminocarbazole, brominated poly-N-vinyl carbazole, copolymers of N-vinylcarbazole and methylacrylate, poly-9-vinylanthracene, poly-1-vinylpyrene, polymethylene pyrene, N-substituted polymeric acrylic acid amides of pyrene, pyrene, tetraphene, 1-acetylpyrene, 2,3-benzochrysene, 6,7-benzopyrene, 1-bromopyrene, 1-ethylpyrene, 1-methylpyrene, perylene, 2-phenylindole, tetracene, picene, 1,3,6,8-tetraphenylpyrene, chrysene, fluorene, fluorenone, phenanthrene, triphenylene, 1,2,5,6-dibenzanthracene, 1,2,3,4-dibenzanthracene, 2,3-benzopyrene, anthraquinone, dibenzothiophene, and naphthalene, said top layer being substantially visible ray transmissive and substantially non-light sensitive in the visible range in the absence of a sensitizer;

the sensitizer for said top layer consisting essentially of vitreous selenium or selenium/tellurium layer b.

* * * * *